US005711663A

United States Patent [19]

Giebel et al.

[11] Patent Number: 5,711,663

[45] Date of Patent: Jan. 27, 1998

[54] BURNER

[75] Inventors: Michael Giebel, Joplin; Steven Speck; Henry Schubert, both of Neosho, all of Mo.; Robert F. Minor, Sr., DeBary, Fla.

[73] Assignee: Sunbeam Porducts, Inc., Delray Beach, Fla.

[21] Appl. No.: 290,423

[22] Filed: Aug. 14, 1994

[51] Int. Cl.[6] ..... F23D 14/62

[52] U.S. Cl. ..... 431/354; 126/39 R; 126/41 R

[58] Field of Search ..... 431/354; 126/39 R, 126/41 R

[56] References Cited

U.S. PATENT DOCUMENTS

| | | | |
|---|---|---|---|
| 640,427 | 1/1900 | Stephenson et al. . | |
| 1,597,116 | 8/1926 | Skinner . | |
| 2,164,079 | 6/1939 | Parker . | |
| 4,305,372 | 12/1981 | Hahn | 431/354 X |
| 4,705,022 | 11/1987 | Hahn . | |
| 4,901,705 | 2/1990 | Takata et al. . | |
| 4,986,254 | 1/1991 | Haen et al. . | |
| 4,989,579 | 2/1991 | Murphy et al. . | |
| 5,249,958 | 10/1993 | Freber . | |
| 5,391,076 | 2/1995 | Home | 126/41 R X |

*Primary Examiner*—Larry Jones
*Attorney, Agent, or Firm*—Michael J. Kline; Carol L Bordas

[57] ABSTRACT

A gas burner, specifically a gas burner for cooking grills. The burner comprises and elongated conduit member having an upper portion of a generally inverted V-shape, a lower portion defining burner ports angled such that the flame caused by burning gases escaping from the burner port does not impinge upon the lower portion. The cross-section of the elongated conduit member burner provides an increased volumetric flow rate which does not require gas pressure equalization means to provide uniform heat generation across the length of the burner.

5 Claims, 4 Drawing Sheets

BURNER

FIELD OF THE INVENTION

This invention relates generally to an improved gas burner. Specifically this invention relates to gas burners used for outdoor gas cooking grills.

BACKGROUND OF THE INVENTION

Gas burners, such as those used in grills and for heating water and air, are well known in the art. Such burners are typically mounted within a housing and are available in a number of configurations including bar burners, H-shaped burners, U-shaped burners and oval-shaped burners. For example, U.S. Pat. No. 5,249,958 to Freber shows an oval-shaped burner; U.S. Pat. No. 4,989,579 to Murphy, et al. discloses an H-shaped burner and a bar burner; U.S. Pat. No. 4,986,254 to Haen, et al. illustrates a pair of U-shaped burners; and U.S. Pat. No. 4,705,020 to Hahn shows a round burner.

One common problem of prior art burners is that heat is generated unevenly along the burner's surfaces. This occurs because gas pressure is unevenly distributed along the length of the burners. Generally, gas pressure is greater at the burner ports located near the gas input port, and is lower near the burner ports located farther away from the gas input port.

One solution to this problem involves varying the size of the burner ports so that those burner ports nearest the input port have smaller openings and those farthest away from the input port have larger openings, as described in U.S. Pat. No. 4,986,254 to Haen, et al. It is known in the prior art to locate the gas ports on the top of the burner, as shown in U.S. Pat. No. 1,597,116 to Skinner, on the side of the burner, as shown in U.S. Pat. No.4,986,254 to Haen, et al., and to locate the gas port on the bottom of the burner, as disclosed in U.S. Pat. No. 2,164,079 to Parker.

If the burner ports are located on the top or the side of the burner, the grease from the food being cooked on the grill will fall onto the burner ports and cause them to become clogged. Even with side-ported burners, measures must be taken to shield the burner ports from falling grease, as shown in U.S. Pat. No. 4,986,254 to Haen, et al.

A solution to this problem is not easily found. For example, one solution may be turning a top-ported burner upside down so that the burner ports are on the bottom. Although the burner ports will be protected from falling grease, the flame emitted from the burner ports will impinge upon the burner causing extreme heat and shortening the burner's useful life.

In addition to clogged burner ports, falling grease and juices often contain salts and other materials which, if not periodically removed will collect on the burner and prematurely destroy it by corrosion. It is known in the prior art to slope the upper portion of a burner so that drippings and the like will run off of the burner, as disclosed in U.S. Pat. No. 4,986,254 to Haen, et al.

In addition, the temperature near a burner will commonly exceed 400° F., the temperature at which grease burns. As a result, grease and juices will "flare up" if they fall into an open flame, onto the burner or upon "lava rocks" which are located above the burner. These "flare ups" can lead to grease fires which both detract from the grilling experience and are potentially dangerous.

SUMMARY OF THE INVENTION

The present invention relates to an improved burner which may be used for, but is not limited to, burners for use with outdoor grills.

The present invention solves many of the problems inherent in prior art burners. Features of the present invention include a burner with a generally triangular cross-section, which results in good gas pressure equalization without the need for additional equalization measures; a triangular top-portion, which results in little or no grease build up and reduced "flare up"; an angled bottom ported burner, which does not need additional means to protect the burner port from falling grease and juices and which greatly, if not completely, eliminates the impingement of the flame upon the burner; and ribs which span the space formed between a non-linear burner and provide support for ceramic blocks or "lava rock"-types of elements.

DETAILED DESCRIPTION OF THE PREFERRED EMBODIMENT

The improved burner 1 of the present invention may be used for many purposes such as heating air and heating water. A preferred embodiment of the present invention, however, uses the improved burner 1 to heat food in a cooking apparatus such as an outdoor grill.

Figure 1:
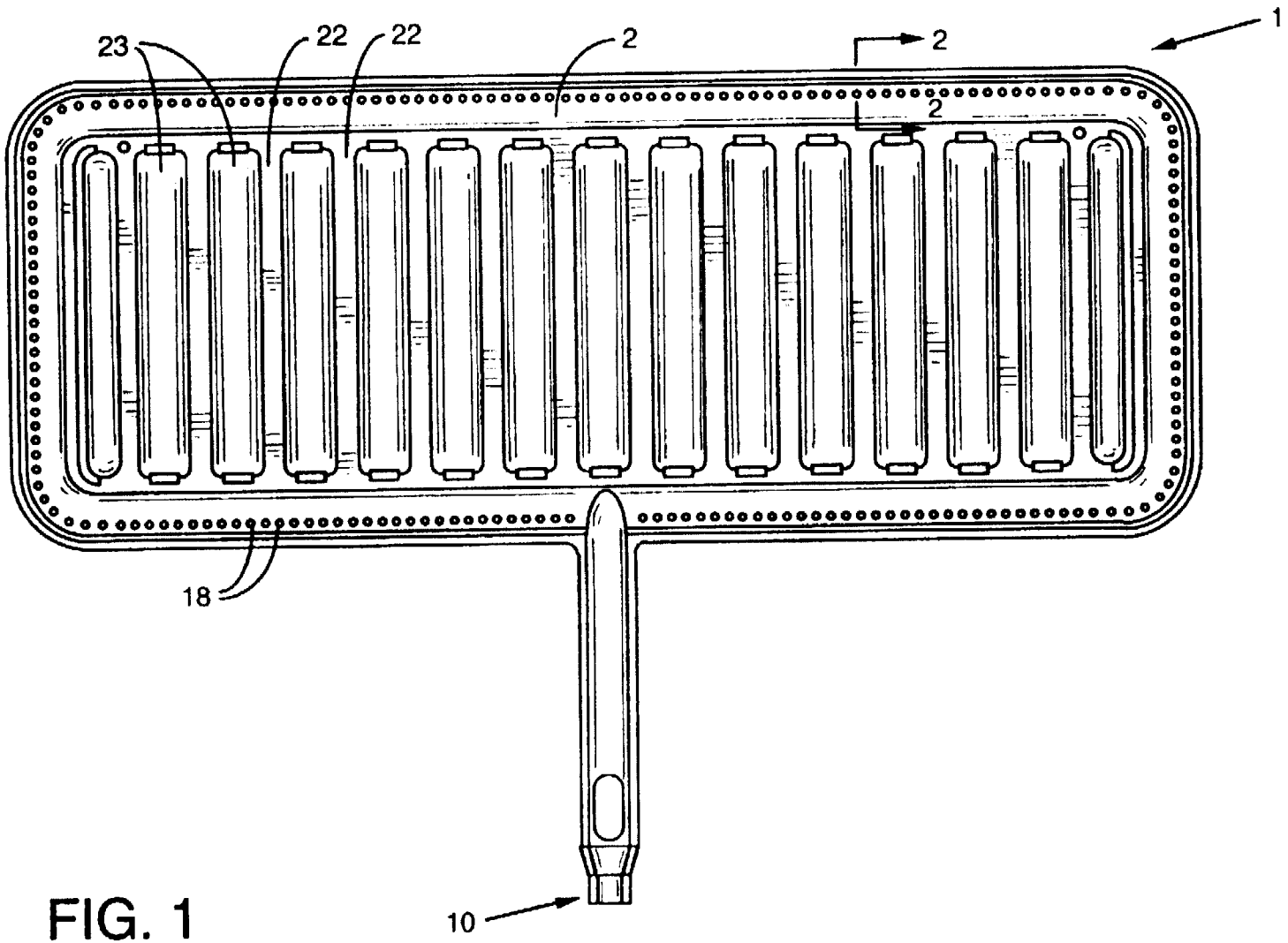
FIG. 1 is bottom plan view of a burner of the present invention.
Figures 2, 3:
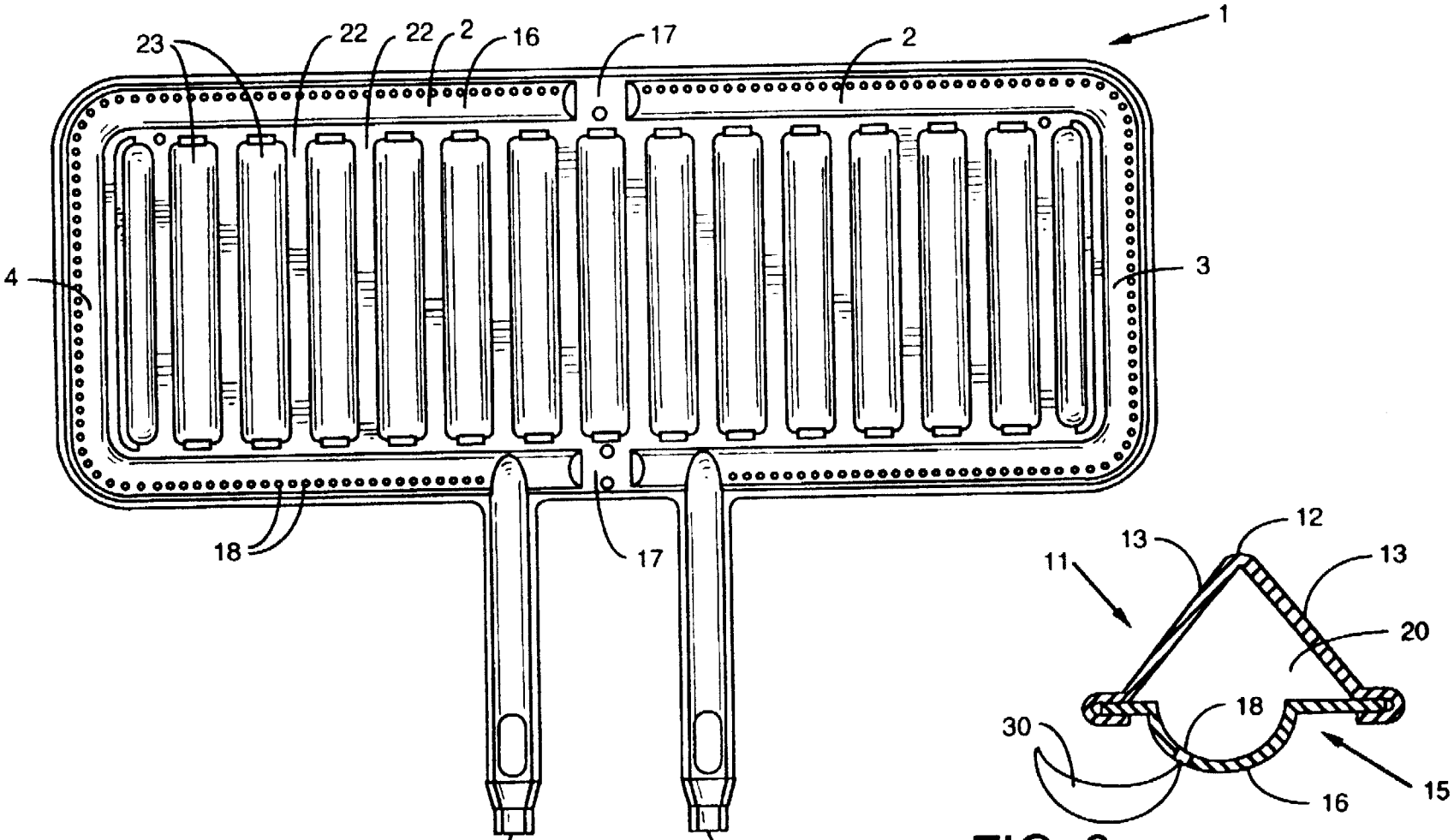
FIG. 2 is a cross-sectional view of the elongated conduit member along the line 2—2 of FIG. 1.
FIG. 3 is a bottom plan view of a burner of the present invention.

As shown in FIGS. 1 and 2, the improved burner 1 comprises an input port 10, and an elongated conduit member 2 comprising an upper portion 11, a lower portion 15, and a plurality of burner ports 18.

The input port 10 is connected to a source of gas or other fuel by means known in the prior art. Means for controlling the flow rate or fuel through the input port are also operatively connected to the burner 1 as is again known in the art.

The upper portion 11 is sloped so that grease and juices that fall from the cooking grid will tend to roll off of the upper portion 11 and drop to the bottom of the grill. This slope is preferably between 40 degrees and 50 degrees from a vertical line. In a most preferred embodiment, the slope is approximately 43 degrees from a vertical line.

Since the buildup of greases and juices from food tends to corrode burners and shorten their useful life, the sloped upper portion 11 of the present invention will increase the life of the burner 1. The angular cross-section of the upper portion 11, as shown in FIG. 2, is defined by a pair of sloping sides 13 which come to an apex 12 approximately in the middle of the upper portion 11. In this embodiment, the upper portion 11 is approximately symmetrical about its vertical axis. In this way, assuming that the distribution of falling grease onto the burner is approximately uniform, half of the falling grease and juices will flow down one sloped side 13 of the burner 1 and half of the falling grease and juices will flow down the other sloped side 13 of the burner 1. For reasons discussed below with respect to the lower portion 15 and the burner ports 18, it may be desireable to alter the cross-section of the upper portion 11 by shifting the apex 12 to one side or the other by altering the angles of inclination of the respective sloped sides 13, so that, for example, sixty percent of the grease and juices fall on one sloped side 13 while forty percent of the grease and juices fall on the other sloped side 13.

Figure 5:
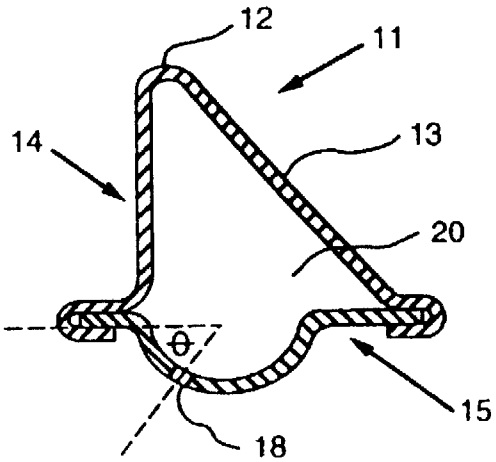
FIG. 5 is a cross-sectional view of the elongated conduit member of a most preferred embodiment of the present invention.
Figure 6:
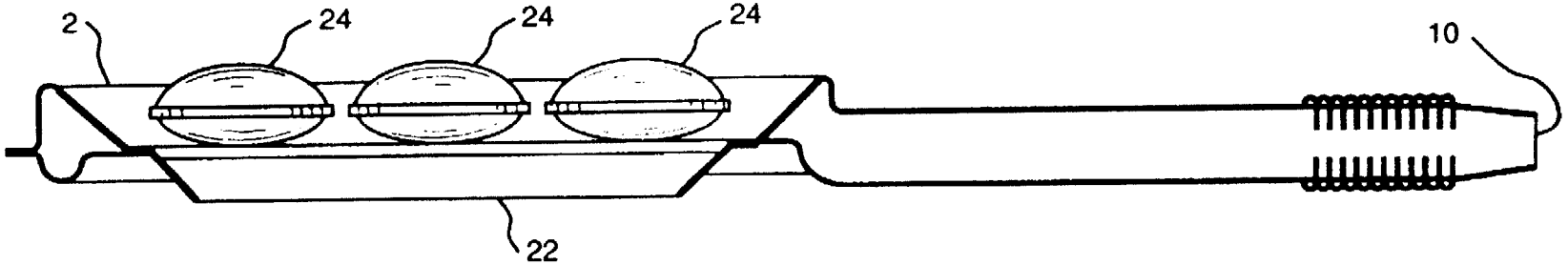
FIG. 6 is a cross-sectional view of the burner having a rib structure taken along line 6—6 of FIG. 4.

In a most preferred embodiment, the burner has a cross section as shown in FIG. 5. The upper portion 11 has a vertical portion 14, an apex 12 located proximate the vertical portion 14, and a single sloped portion 13. The sloped portion 13 is preferably between 40 degrees and 50 degrees from a vertical line. In the most preferred embodiment, the sloped side portion is approximately 43 degrees from a vertical line.

The lower portion 15, as shown in cross-section in FIGS. 2 and 5, contains the burner ports 18 and is affixed to the upper portion 11 so that the left and right sides of both the upper portion 11 and lower portion 15 are attached together. This attachment may be by welding, crimping, or other means known in the prior art. It is important that the attachment of the lower portion 15 to the upper portion 11 creates an air-tight seal, because the passageway 20, formed in the space between the lower portion 15 and the upper portion 11 of the elongated conduit member 2, carries the fuel from the input port 10 to the burner ports 18.

The lower portion 15 also contains a downwardly extending semicircular or arcuate depression 16 in which the burner ports 18 are located.

The burner ports 18 are angled with respect to a vertical line. As seen in FIG. 2, a flame 30 produced by burning gas exiting the burner ports 18 under normal operating conditions does not significantly impinge on the lower portion 15. As seen in FIG. 5, it is preferable that the angle theta of the burner port 18, is approximately 45 degrees from a horizontal line. Since the burner ports 18 are located on the lower portion 15, they are protected from being clogged by grease and juices falling from the food being cooked on the grill. In addition, flare ups can be, if desired, nearly eliminated because the falling grease and juices land on the upper portion 11, slide down the sloped sides 13 and, in large part, fall to the bottom of the grill. Since the burner 1 is not subject to impingement from the flame, the upper portion 11 of the burner 1 does not get hot enough to cause any significant flare ups when grease and juices fall upon it.

Other shapes for the lower portion 15 are also possible, such as a semi-circular or triangular cross-section comprising the entire lower portion 15. If a single piece of conduit, such as one with a square or rectangular cross-section, is used, the upper portion 11 could have a triangular cross section and the lower portion 15 could have an inverted triangular cross-section. Such an embodiment would provide an angled upper portion 11 to allow the grease and juices to run off of the burner, as well as an angled lower portion 15 to house the burner ports 18. Similar results may be obtained with a conduit having a circular or elliptical cross-section.

If the apex 12 of the upper portion 11 is located in approximately the middle of the upper portion 11, about half of the grease and juices will roll down the sloped side 13 towards the flame caused by burning gas escaping from the burner ports 18. Much of the grease and juices which fall from the upper portion 11 into the flame will burn and add flavor to the food being cooked on the grill. By varying the position of the apex 12 in the upper portion 11, one can vary the amount of falling grease and juices which come in contact with the flame. In this way, the burner 1 can be tailored to meet the amount of flavoring desired.

As can be seen in FIG. 2, the cross-section of burner 1, exclusive of depression 16, is triangular. This design provides increased volume over conventional burners. The depression 16 acts to further increase volumetric flow rate capacity through passageway 20. This increased volume provides good equalization of gas pressure along the entire length of the elongated conduit member 2. As a result, pressure equalization measures are not necessary with a burner 1 of the present invention.

The burner 1 of the present invention may be made into any shape, such as linear, oval, H-shaped and U-shaped. The preferred embodiments shown in FIGS. 1, 3 and 4 have a rectangular shape.

Figure 4:
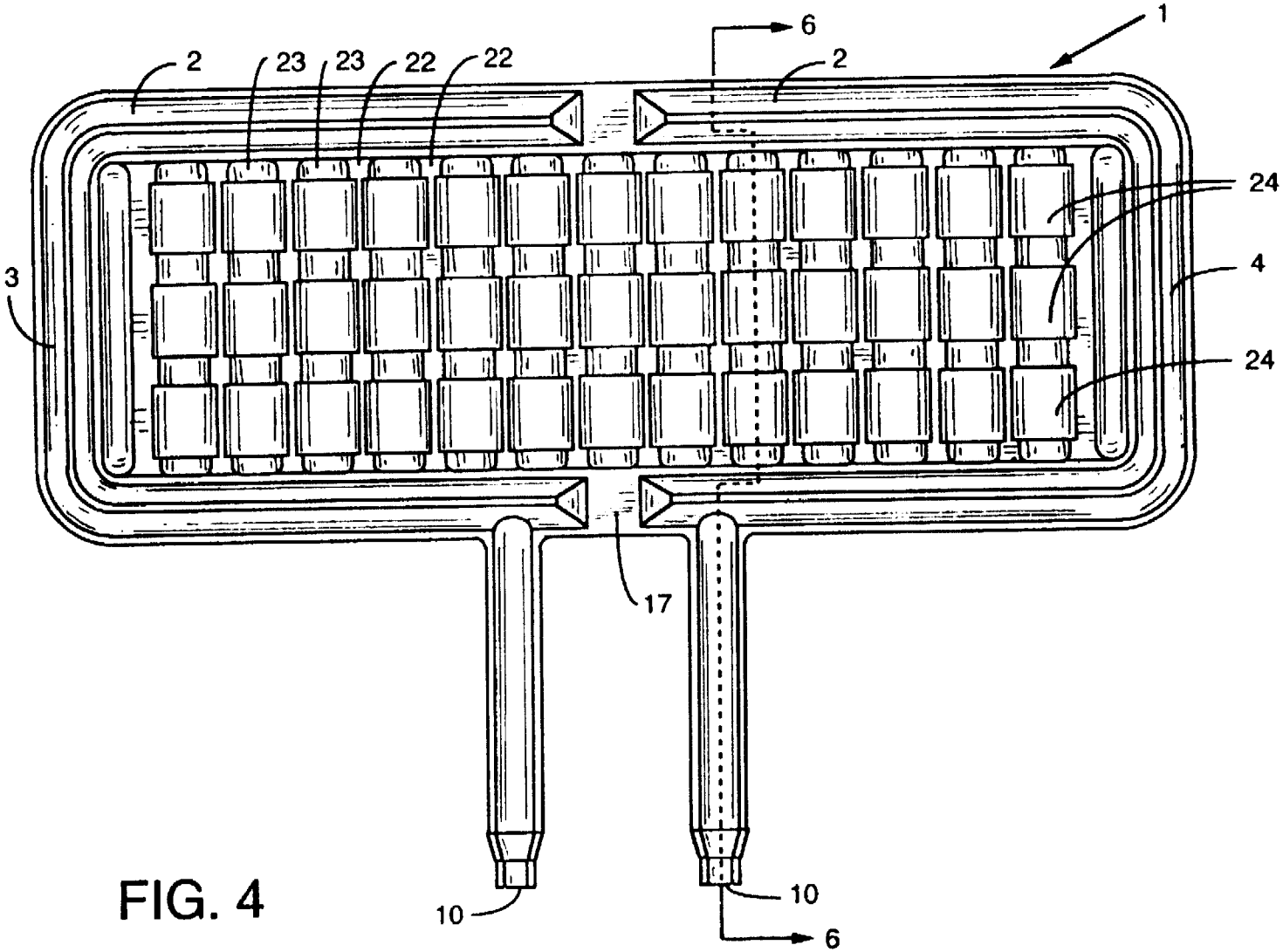
FIG. 4 is a top plan view of a burner of the present invention.

As best seen in FIGS. 1, 3 and 4, and 6 a most preferred embodiment of the burner 1 includes parallel ribs 22 disposed between the long sides of the rectangular burner 1. Open spaces 23 are located between the parallel ribs 22. As shown in FIG. 4, the ribs 22 may be used to support ceramic blocks 24 for purposes which are both aesthetic and functional.

In a most preferred embodiment of the present invention, the burner ports 18 are angled towards the outside of the burner 1 and away from the ceramic blocks 24 located in the center of the burner 1. This provides even heating of the food without directly heating the ceramic blocks 24 in the center of the burner 1. This keeps the ceramic blocks 24 cool enough so that they do not cause flare ups when grease and juices fall upon them. This feature is particularly useful when using a rotisserie to cook food over the grill.

The burner may be constructed from materials known in the art to have characteristics which are favorable to the burner's environment. Typical burners are either aluminized or stainless steel. It is preferable, however, that the burner be porcelain coated. It has been found that porcelain coated burners outperform aluminized burners and perform at least as well as stainless steel burners. In addition, porcelain coated burners have superior corrosion resistance than either aluminized or stainless steel burners.

As illustrated in the drawings, burner 1 may be modified to provide one or more temperature control zones so that the temperature of different sections of the grill can be varied for cooking several different foods at one time. For example, FIG. 1 illustrates a burner 1 having only one gas input port 10 and only one temperature control zone. In contrast, the embodiments shown in FIGS. 3 and 4 have two independent burners 3 and 4 which yield two temperature control zones, with each burner 3 and 4 subject to independent control by the user. In those embodiments, two input ports 10, one for each independent burner 3 and 4, are provided. It is, of course, possible to provide a single input port 10 which branches into two or more tubes, with each tube containing a mechanism, such as those known in the prior art, to control the flow of gas therethrough.

The burner 1 shown in FIGS. 3 and 4 includes a separation means 17 which separates the opposing U-shaped burners 3 and 4 which form the two temperature control zones. The separation means 17 is a solid crimped portion of the burner 1. As a result, the separation means 17 prevents the exchange of gaseous fuel from one burner 3 to the other 4. Other means of separating the burners 3 and 4 are also possible.

Although the invention has been described in detail in the foregoing for the purpose of illustration, it is to be understood that such detail is solely for that purpose, and that variation can be made therein by those of ordinary skill in the art without departing from the spirit and scope of the invention as defined by the following claims. All such variation are specifically intended to be embraced within the scope of the following claims, including all equivalents thereof.

We claim:

1. A gas burner, comprising:

(a) an input port in fluid communication with an elongated conduit member; said conduit member comprising an upper portion having a pair of sloping sides joined at an apex and having an angular cross-section, a lower portion having a depression, and including a plurality of spaced apart burner ports; said elongated conduit member further having an enclosed shape defining an open space therewithin; said plurality of spaced apart burner ports positioned on an outside portion of said depression with respect to a vertical center line through a cross-section of the depression; and (b) a plurality of rib members spanning the open space within said elongated conduit member.

2. The gas burner of claim 1, wherein:

said plurality of rib members support a plurality of ceramic blocks thereon.

3. The gas burner of claim 2, further comprising:

(a) a separation means which separates said elongated conduit member into a first and a second elongated conduit member wherein said input port is in fluid communication with said first elongated conduit member; and (b) a second input port is in fluid communication with said second elongated conduit member.

4. The burner of claim 1, wherein:

said conduit member is made from a material selected from the group comprising steel and aluminum.

5. The burner of claim 4, wherein:

said conduit member is porcelain coated.

* * * * *